United States Patent [19]

Cook

[11] 4,408,505

[45] Oct. 11, 1983

[54] MULTIPURPOSE RATCHETING WRENCH

[76] Inventor: E. Wayne Cook, 4455 Delespine Rd., Cocoa, Fla. 32922

[21] Appl. No.: 185,764

[22] Filed: Sep. 10, 1980

[51] Int. Cl.³ ..... B25B 13/28

[52] U.S. Cl. ..... 81/98; 81/437

[58] Field of Search ..... 81/58.5, 98, 437; 7/138

[56] References Cited

U.S. PATENT DOCUMENTS

| | | | |
|---|---|---|---|
| 651,574 | 6/1900 | Meredith | 81/98 |
| 1,754,717 | 4/1930 | Hughens | 81/98 |
| 2,148,573 | 2/1939 | Mulcay | 81/437 X |
| 3,599,255 | 8/1971 | Carroll, Sr. | 7/138 |
| 3,670,604 | 6/1972 | Fromell | 81/98 |

*Primary Examiner*—James G. Smith

*Attorney, Agent, or Firm*—Duckworth, Allen, Dyer & Pettis

[57] ABSTRACT

A multipurpose ratcheting wrench is disclosed for turning components such as fire hydrant valve stems and the like. The wrench includes a lever which defines cam surfaces between the distended ends thereof. A gripping head is movably coupled to the lever adjacent the cam surfaces for receiving the component to be turned therethrough and for automatically closing toward the cam surfaces so as to engage the component therebetween. As the lever is rotated, the cam surface is pressured into communication with the component to be turned and therefore increase the grip of the wrench thereon. Two separate cam surfaces are provided, one which is adjacent to the gripping head when in the opening mode, and another cam surface which is adjacent to the gripping head located in the closing mode. A spinning handle is provided at the opposite end of the lever and is oriented generally parallel with the axis of rotation of the component being rotated.

8 Claims, 5 Drawing Figures

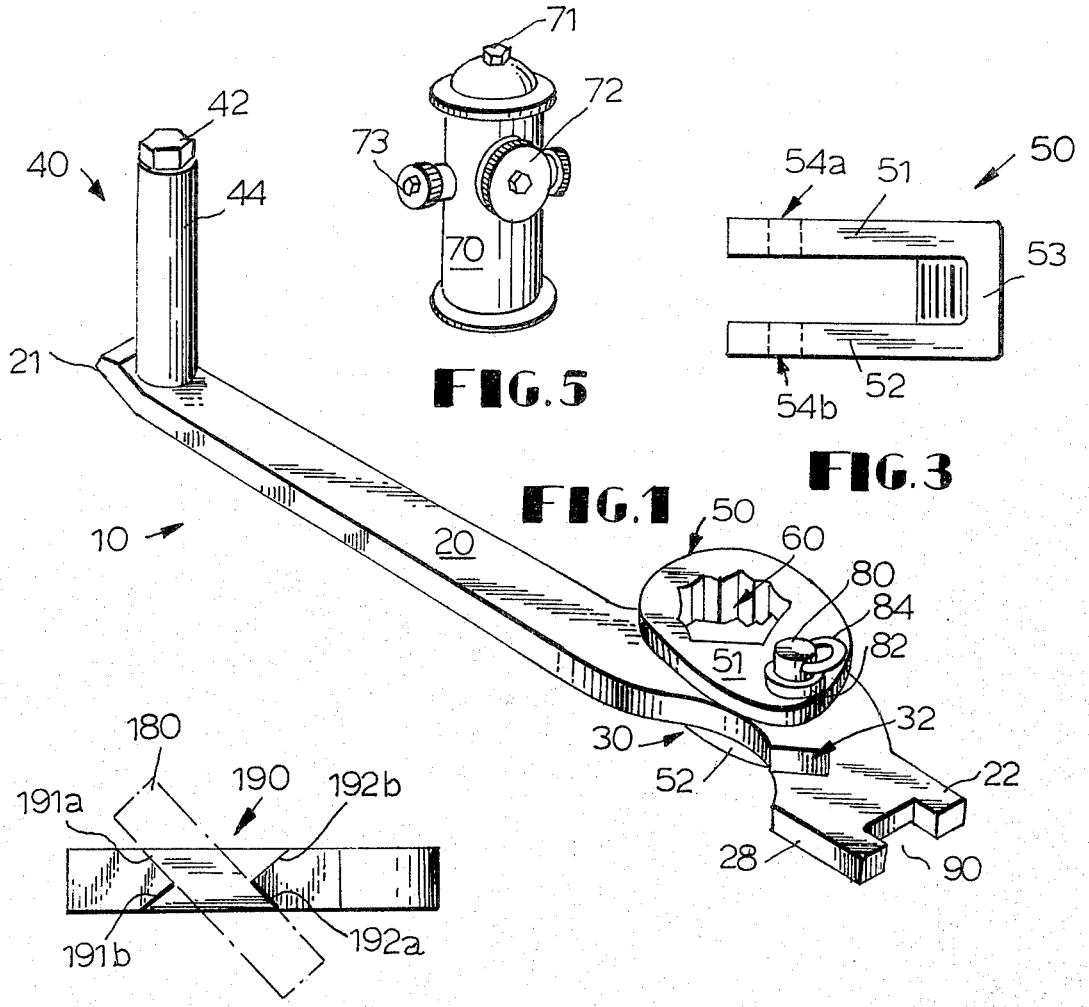
FIG. 5
FIG. 3
FIG. 1
FIG. 4
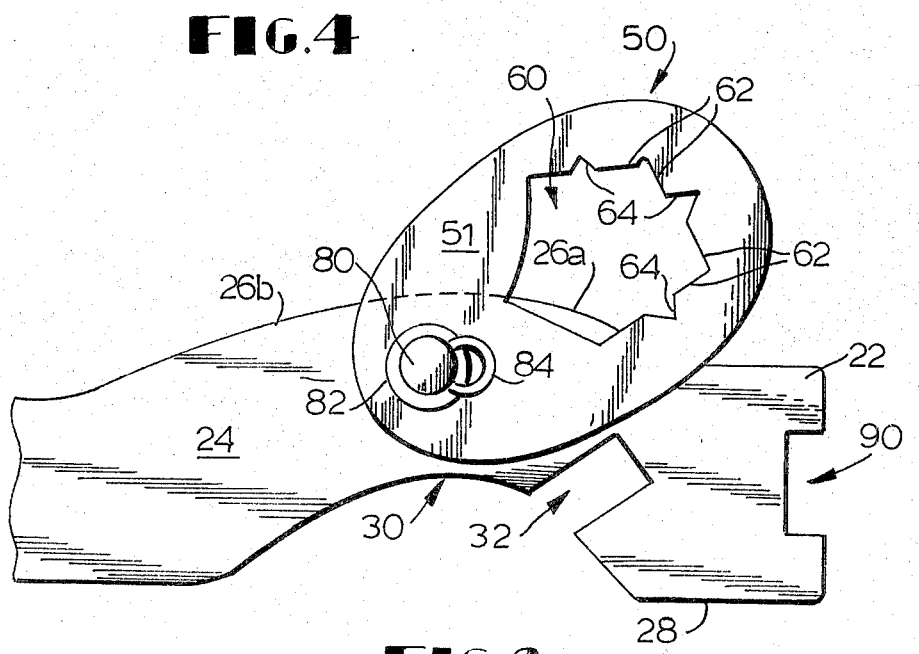
FIG. 2

MULTIPURPOSE RATCHETING WRENCH

BACKGROUND OF THE INVENTION

I. Field of the Invention

The present invention relates to a multipurpose ratcheting wrench, and more specifically to a ratchet type wrench which is designed for use on fire hydrants, water meters, gas meters, and fire hose couplers. While the present invention is disclosed with regard to these primary functions, it will be understood that the wrench may be used for a variety of other functionally equivalent purposes.

II. Description of the Prior Art

When emergency service personnel, such as firefighters, are requested to perform services on an emergency basis, it is extremely important that they have at their immediate disposal all of the tools which would typically be required in the course of the normal emergency activities. In the specific case of a firefighter fighting a fire, a firefighter repeatedly performs activites which are so common that their occurrence can be predicted with great regularity. For example, any reasonable sized fire requires that the pumping engine be coupled to a fire hydrant to supply the required water. While many fire hydrants are relatively new and accessible to the fire fighting personnel, older fire hydrants have valve stems and cap nuts which have rounded edges or which have been reduced in size during refurbishing operation. Furthermore, many of the fire hydrants are not easily accessible to the firefighters because of the growth of adjacent bushes, the recent placing of fences or other obstructions nearby, and more commonly the accretion of soil around the base of the fire hydrant, all of which combine to reduce the clearance (or clear area) between the ground and the capped nut or valve stem.

The fire fighting personnel also must concern themselves with cutting off normal water service to the burning structure so that heat will not burst the water service pipes within the building which would result in a drastic drop in water pressure used in the fire fighting procedures. It is extremely important that the fire fighting personnel have immediate access to the main water service control valve for each structure so that it may be cut off at the earliest possible time. As with the case of the fire hydrants described above, many factors contribute to limit the access to the main water control valve, including the accretion or build up of soil, other obstructions such as fences, etc., and the oxidation and general deterioration of the material used in the valve stem.

Similar problems are faced by the fire fighting personnel in closing off natural gas lines, prying open valve cover doors (such as on water valves and gas valves) and impacting other tools or structural elements.

It is also important for the fire fighting personnel to be able to quickly and positively couple and uncouple the relatively large fire hose couplers. If each of these fire hose couplers are not sufficiently tightened, then the sequential leaks in a long length of fire hose may substantially reduce the water supply and water pressure available for fighting the fire. On the other hand, if the fire hose couplers are tightened too much, then it is difficult to disengage the couplers without damaging them. It is therefore important to have a tool which may be used to apply a controlled torque in tightening the fire hose couplers and which will not damage the couplers when they are disengaged.

The prior art has sought to solve these problems by creating separate tools with attributes suitable for each purpose. While this has been somewhat suitable in the past, the loss or nonavailability of certain tools in various instances has contributed to increased damages caused by the failure to timely cut off water, gas or other valves leading to the threatened structure. Experience has indicated to the present inventor that there is a strong demand for a multiple purpose tool which can be used by an experienced firefighter in order to accomplish each of these required tasks. The multiple purpose tool must combine sufficient elements and functional cooperations in order to accurately and reliably handle these requirements, while at the same time not unduly burdening the firefighter with the weight of multiple tools and the concomitant burden of storing the individual tools.

Warren in U.S. Pat. No. 2,733,625 discloses a wrench for servicing fire hydrants. The wrench includes an open end spanner wrench and a closed end wrench which is pivotally coupled thereto so that the operative openings of each wrench are generally coaxial with each other. In this manner the valve stem or cap nut of the fire hydrant may be inserted coaxially through both the open end and closed end wrenches, and then the operator may rotate the handle of the wrench so as to cause the open and closed end wrenches to couple around the stem in scissors fashion in order to provide a more secure grip on the stem. This complex wrench will operate in both directions, but the wrenches are located on a distended end of the handle which is extremely inconvenient. Also, the opposite end of the handle includes a spanner element for operating on fire hose couplings.

In cases where extensive torque is required in order to open the fire hydrant, the fireman must exert the additional torque directly upon the spanner element which could cause severe lacerations and injuries to the hands. It should also be noted that the wrench as disclosed by Warren is not suitable for rapidly opening the valve stems or cap nuts on the typical fire hydrant since the wrench as illustrated does not include a handle which can be rapidly rotated a full 360 degrees. In other words, the firefighting personnel must rotate the wrench approximately 180 degrees, and then release, and then regrip the handle of the wrench in order to complete the 360 degree rotation. Furthermore, the spanner wrench is too small for use on valve stems utilized on water meters, and thus the wrench would not be suitable in this application. On the other hand, the wrench is too large to fit into meter boxes so as to engage valve stems therein.

Meredith in U.S. Pat. No. 651,574 discloses an adjustable spanner wrench which includes an arcuate shaped surface and a closed end wrench pivotably coupled thereto. These two elements are movably coupled by the pivot such that when a valve stem, or other similar operative element, is inserted through the arcuate element when torque is exerted on the handle for either tightening or loosening the stem. It should be noted that this wrench operates only in one direction, since the exertion of torque in a direction opposite from the desired direction will not cause the closed end wrench to couple with the arcuate element in a fashion so as to clamp the valve stem therebetween. The handle of the wrench disclosed by Meredith is not suitable for rapid 360 degree rotation. Meredith utilizes a hexagonal opening in the wrench which in many cases is not suitable for use on fire hydrants.

Pollard, in U.S. Pat. No. 282,768, discloses a stud wrench of the type which would not be suitable for coupling with valve stems, cap nuts or other six-sided elements. The pivotal coupling between the closed end wrench and the arcuate face will allow the exertion of torque upon the operative element only in one direction, and therefore the wrench cannot be used for both opening and closing the stem on a fire hydrant. The operative elements of the wrench are included at a distended end thereof which is inconvenient for the reasons previously explained. The use of teeth on the arcuate surface would tend to destroy the valve stems and cap nuts on fire hydrants. The wrench is also not suitable for use in fire fighting applications because it does not include striking, prying, chiseling or driver elements nor does it include capabilities for manipulating with fire hose couplers.

Mason, in U.S. Pat. No. 1,380,822, discloses a somewhat improved version of the stud wrench of Pollard (above). The improvement disclosed by Mason primarily relates to the incorporation of a perpendicular handle coupled to the distended end of the main lever. This perpendicular handle allows the operator to make continuous 360 degree rotations of the wrench as required in fire fighting applications. However, as was previously discussed with Pollard, the wrench disclosed by Mason will exert torque only in one direction and is therefore not suitable for use on fire hydrants, etc.

Viau, in U.S. Pat. No. 668,467, discloses a pipe wrench which employs a closed end fitting which interacts with a surface of the torque shaft to rotate the pipe in either direction. This wrench includes at a distended end thereof a V-shaped element, which has one side which couples with the pipe for rotation in one direction, and a second side which couples with the pipe for rotation in the opposite direction. The closed end portion of the wrench includes an aperture therein for receiving the pipe therethrough as it is rotated in one direction. In contrast to the present invention, the pipe must be removed from within the aperture and placed adjacent to a claw on the outside surface of the closed end wrench when it is used for exerting torque in the opposite direction. The requirement to remove the turned element from within the aperture in order to reverse the direction of application of the torque is not well suited for fire fighting applications. The grooved jaws on the Viau device would destroy the valve stem of a fire hydrant and then would not be suitable for the present applications.

Bettman and Talkington, in U.S. Pat. No. 701,462, disclose a wrench which includes at a distended end thereof a closed loop for forcing the valve stem against an arcuate or flat portion of the distended end of the wrench as it is rotated. As with previous disclosures, this wrench is capable of exerting torque only in one direction and is therefore not suitable for most fire fighting applications.

Fromell, in U.S. Pat. No. 3,670,604, discloses a complex wrench similar to those previously discussed, except that two pivots are utilized for purposes of stabilizing the rotation of the closed end wrench about the distended end of the handle. While the wrench will exert torque in both directions, the small surface couplings between the distended end of the wrench and the valve stem would not make this wrench suitable for fire fighting application.

Pasbrig, in U.S. Pat. No. 4,084,456, discloses a complex torque wrench similar to those previously discussed except the distended end of the handle is pivoted so as to provide additional mobility and angular adjustments for specific application. The design of the nose and closed end sections of the wrench make it suitable only for the application of torque in one direction. Ross, in U.S. Pat. No. 384,592, discloses a combination tool which includes both a wrench and a screwdriver.

While each of these tools may be useful for the particular application to which it relates, none of these tools nor any combination thereof would be suitable for the specialized requirements as previously discussed with regard to fire fighting applications. In contrast to the prior art, the present invention envisions the use of a closed end wrench which will cooperate with the lever element in order to produce torque in either direction. The lever must be suitable for a 360 degree rotation of the valve stem as required in the rapid opening or closing of the fire hydrant. In this manner the fire fighter may utilize only one hand to operate the wrench, thus freeing the other hand for other duties. The present invention envisions an instant release of the valve stem from the wrench by merely rotating the wrench in the opposite direction from the torque previously exerted. The present invention also envisions the use of positive tightening of the closed end wrench toward the lever when torque is exerted in either direction. Furthermore, the wrench must be suitable for ratcheting through the use of quick opposite direction torque movements so that valve stems and cap covers may be removed from the fire hydrant when limited clearances are available. The present invention envisions a notch suitable for coupling with water meter valves. This notch must be located in an end of the lever suitable for penetrating below ground level and into the box containing the water meter valve. The present invention also envisions the use of a spanner element suitable for operating on fire hose couplers.

SUMMARY OF THE INVENTION

The present invention relates to a multipurpose racheting wrench for turning components such as fire hydrant and water meter valve stems. The wrench includes a lever which defines cam surfaces between the first and second ends thereof. A gripping head is provided for receiving the component to be turned. The gripping head is movably coupled to the lever adjacent the cam surfaces for automatically closing toward the cam surfaces so as to engage the component therebetween responsive to torque being exerted on the first end of the lever. The gripping head moves between a first position adjacent a first cam surface used for tightening the component, and a second position adjacent a second cam surface for untightening the component. A handle is provided adjacent the first end of the lever and is oriented generally perpendicular to the axis of rotation of the component being turned.

BRIEF DESCRIPTION OF THE DRAWINGS

Other objects, features and advantages of the present invention will be apparent from a study of the written description and the drawings in which:

FIG. 1 illustrates a frontal perspective view of a first preferred embodiment of the ratcheting fire service wrench in which the gripping head is shown in the closing or tightening position.

FIG. 2 is a top plan view of the second end of the fire service wrench showing the gripping head in the position for opening or loosening the article to be turned.

FIG. 3 is a side elevation of the gripping head as removed from the fire service wrench.

FIG. 4 is an elevation of the second end of a second preferred embodiment of the fire service wrench.

FIG. 5 illustrates a typical fire hydrant of the type for which the present invention has been designed.

In the drawings, like reference characters refer to like parts throughout the several views of each of the embodiments of the present invention. However, variations and modifications may be effected without departing from the spirit and scope of the concept of the disclosure and the appended claims. It should be observed that the elements and operation of the embodiments of the present invention have been illustrated in somewhat simplified form in each of the drawings and in the following specification in order to eliminate unnecessary and complicating details which would be apparent to one skilled in this art. Therefore, other specific forms and constructions of the invention will be equivalent to the embodiments described although departing somewhat from the exact appearance of the drawings.

DETAILED DESCRIPTION OF THE PREFERRED EMBODIMENT

A first preferred embodiment of the multipurpose fire service wrench is illustrated generally as 10 in FIGS. 1 and 2. The wrench 10 is composed of three main elements, namely an elongated lever 20, a generally upstanding spinning handle 40 which is coupled to the lever 20 adjacent a first end 21 thereof, and a gripping head 50 which is located adjacent to but spaced from a second end 22 of the lever 20.

The lever 20 is approximately 18 inches long as measured from a first end 21 to the second end 22. This dimension is somewhat critical in that the lever must be short enough to clear between the ground surface and a cap nut 73 located on a cap 72 attached to a fire hydrant 70 of the type illustrated in FIG. 5. The lever 20 includes a generally convex arcuate section 24 which is adjacent to but spaced from the second end 22. The arcuate section 24 defines a cam surface, shown generally as 26, which is actually composed of a first cam surface **26*a* and a second cam surface 26*b* which are generally continuous in their intersection. As will be explained subsequently, the first cam surface 26*a* is primarily utilized in the untightening process, while the second cam surface 26*b* is primarily utilized when the wrench 10 is used to tighten the component to be turned. While FIG. 2 illustrates the cam surfaces 26** as being arcuate in shape, it is apparent that these surfaces may also be straight edges if this design is more suitable for the particular application to which the tool is being applied.

With continuing reference to FIGS. 1 and 2, a pivot pin 80 communicates perpendicularly through the arcuate section 24 of the lever 20 at a position which is generally located along a bisector line of the cam surfaces 26. The pivot pin 80 includes an enlarged upper end (not shown), and a threaded lower end 82 to which is coupled a hex nut and snap ring 84 for securing the pivot pin 80 to the lever 20. However, other pivotal elements of different construction may be substituted for the pivot pin 80.

The pivot pin 80 is used to movably couple the gripping head 50 into a position generally adjacent and external to the cam surfaces 26 of the arcuate section 24 of the lever 20. The gripping head 50 is formed with a U-shape such that the distended ends of an upper element 51 and a lower element 52 are coupled together to form a common distended section 53. The separated ends of the elements 51 and 52 include bores therein, **54*a* and 54*b*, which allow the pivot pin 80** to movably couple therethrough.

The upper element 51 and the lower element 52, together with the distended section 53 of the gripping head 50, combine to define a gripping aperture 60 therein. This gripping aperture 60 typically has a five sided or pentagonal shape. The three sides 62 of the gripping aperture 60 which are furthest away from the pivot pin 80 also includes a notch therein for allowing the gripping aperture 60 to couple around unusually shaped components. The distended section 53 of the gripping head 50 typically forms a solid face along the three most external sides 62 of the gripping aperture 60 in order to provide a more durable coupling with the article or component to be turned.

The sides 62 of the gripping aperture 60 are spaced radially from the pivot pin 80 by a distance which will allow the turned component to be inserted between the sides 62 and the cam surfaces 26. From the view illustrated in FIG. 2, it will be apparent that the curvature of the cam surfaces **26*a* and 26*b* on the arcuate section 24 will be calculated such that a flat surface of the component to be turned will be generally parallel to and juxtaposed with the cam surface 26, while the remaining flat sides of the component to be turned will generally mate with and be parallel to the sides 62 of the gripping aperture 60 within the gripping head 50. The curvature of the arcuate section 24 of the lever 20 is likewise determined to provide sufficient strength and rigidity to the lever 20 over its entire length, and to provide sufficient material over the cross-section of the lever 20 so that the wrench will not buckle or twist when torque is applied to the first end 21** thereof.

The arcuate section 24 of the lever 20 also defines a concave or spanner surface 30 having a notch 32 therein. The curvature of the spanner surface 30 as well as the dimensions and depths of the notch 32 are determined in order to properly couple with the lugs and external circumferential surfaces of typical fire hose coupler. Torque may be exerted upon the first end 21 of the lever 20 in order to provide either a tightening or a loosening torque upon the fire hose coupler as required.

The distended section of the first end 21 of the lever 20 has been beveled to a relatively sharp edge in order to form a screwdriver or chisel or prying tip. This tip 21 may be utilized to pry open the cover of a recessed or underground water control box and for various other purposes of a similar nature. The opposite end 22 of the lever 20 has a generally flat surface of substantial cross-section which is generally perpendicular to the beveled surface 21. In this manner a hammer or other massive instrument may be used to impact the second end 22 of the lever 20 so that the beveled surface 21 may be utilized as a chisel. It is presently envisioned that the center portion of the beveled surface 21 and the center portion of the second or flat end 22 of the lever 20 would both lie along and be centered with respect to a longitudinal axis of the lever 20.

The spinning handle 40 includes a grip 44 which is relatively free to rotate about a bolt 42 which has a threaded end thereof coupled into the first end 21 of the lever 20. The spinning handle 40 will allow the operator to make rapid and continuous 360 degree rotations of the multiple-purpose wrench 10 about the components to be turned. In the case of the fire hydrant 70 as illustrated in FIG. 5, once the valve stem 71 has been inserted through the gripping aperture 60 within the gripping head 50, the firefighter can easily open the valve stem 71 on the top of the fire hydrant 70 by making several complete rotations of the handle 40. The inclusion of the spinning handle 40 substantially increases the torque and speed which may be exerted upon the component to be turned since it is no longer necessary for the operator to rotate the lever 180 degrees and then to regrip the lever in order to allow it to be rotated the remaining 180 degrees. In the first preferred embodiment of the present invention, the rotational axis of the spinning handle 40 is designed to be generally parallel to the rotational axis of the component to be turned. The spinning handle 40 may also be used as a holder for the hydrant cap 72 of the fire hydrant 70 when the wrench is in the operating position on the fire hydrant valve stem 71. The operator merely places the cap 72, with the cap nut 73 up, on the vertical section of the spinning handle 40.

The second end 22 of the lever 20 includes a generally flat surface 28 generally parallel to the longitudinal axis of the lever 20 and displaced perpendicularly therefrom. This surface 28 is designed to be used like the head of a hammer for striking various objects.

The second end 22 of the lever 20 also includes therein a typical rectangular notch illustrated generally as 90. The dimensions of this notch are sized so as to receive and turn the handle/valve stem of the typical master water control valve or gas valve. A second preferred embodiment of the second end 22 of the lever 20 is illustrated in FIG. 4 as including a notch 190 which is formed from first and second opposing sides 191 and 192. The first opposing side 191 is formed from two intersecting sides, **191*a* and 191*b*, while the second opposing side is likewise formed from two intersecting sides 192*a* and 192*b*. The two sides 191*a* and 192*a* are generally parallel to each other but perpendicularly offset from a common parallel line by a distance which is substantially equal to the thickness of the valve stem or handle 180 of a typical water meter valve. Thus, surfaces 192*a* and 191*a* will combine to produce torque upon the handle of the water meter valve or gas valve when the lever 20 is rotated in one direction, while the similarly oriented faces 191*b* and 192*b* will combine to produce opposite torque when the lever 20** is rotated in the reverse direction.

It will be apparent that the spinning handle 40 may be rotated in a generally horizontal plane when a second end 22 of the lever 20 is inserted into a subterranean meter box. Thus, the spinning handle 40 will allow the operator to exert additional torque over and above what would normally be exerted through merely twisting the first end 21 of the lever 20. The size of the notches 90 and 190 have been determined such that they will be useable not only on water meter valves, but also on gas meter valves etc. The maximum width of the lever 20, including the gripping head 50, is such that the second end 22 of the multipurpose wrench 10 may be lowered into a subterranean water control box so that the notches 90 and 190 can engage the control valve of stem for rotation.

A pivot pin ring 84 is coupled through the head section of the pivot pin 80 in order to provide a means for carrying, handling or attaching the multipurpose ratcheting wrench 10 to a lanyard, bracket, bolt, hook or other such appliance. Thus, the single multipurpose ratcheting tool 10 will replace at least 10 separate tools without sacrificing any performance capabilities and with a significant reduction in weight.

The operation of the first preferred embodiment of the multipurpose fire service wrench 10 should now be apparent. In order to place a fire hydrant 70 into operation, the operator merely inserts the cap nut 73 through the gripping aperture 60 of the gripping head 50 and rotates the spinning handle 40 in a counterclockwise direction. This will automatically force the gripping head 50 into the position illustrated in FIG. 2. It will be apparent that the effective length of the operative lever arm (that is the distance between the center of the gripping aperture 60 and the spinning handle 40) will be somewhat longer than when the multipurpose wrench 10 is used to tighten a valve stem or nut. This particular geometry has been chosen because the typical hydrant valve stems are more difficult to open than they are to close. Therefore, the additional increase in the length of the effective lever arm is required for opening more than for closing the component to be turned.

After the cap 72 has been removed, the operator may attach the coupling from a fire hose onto the discharge port of the fire hydrant 70. This fire hose coupling may be tightened by inserting the coupling lug or locker pin into the notch 32 and placing the spanner surface 30 of the wrench 10 along the outside circumference of the coupling. A clockwise force may then be applied to the spinning handle 40 in order to tighten this connection.

The operator may then activate the fire hydrant by inserting the gripping aperture 60 of the gripping head 50 over the valve stem 71 of the fire hydrant 70, and then rotating the spinning handle 40 in the counterclockwise direction. This will force the gripping head 50 into the position shown in FIG. 2.

The fire hydrant may be deactivated by following the reverse procedures. The valve stem 71 may be inserted through the gripping aperture 60 of the gripping head 50 and the spinning handle 40 may be rotated in the clockwise direction thereby forcing the gripping head 50 into the position illustrated in FIG. 1. Further rotation of the lever 20 will cause the valve stem 71 to rotate in a direction for cutting off the water flowing through the fire hydrant 70.

It will be apparent from a study of the drawings and the previous written description that when torque is exerted upon the spinning handle 40 so as to cause a counterclockwise rotation of the component to be opened, the cam surface **26*a* will move in a direction so as to reduce the effective diameter of the gripping aperture 60 within the gripping head 50 until the valve stem or other component to be turned is tightly compressed against the sides 62 of the gripping aperture. It should also be apparent that as more torque is exerted on the spinning handle 40, then more pressure will be exerted by the cam surface 26*a* upon the sides 62 of the gripping aperture 60. This concomitant increase in gripping power as compared to the turning torque exerted by the operator will greatly enhance the ability of the multipurpose wrench 10** to successfully engage and open valve stems which have become rounded from use or even valve stems which have non-standard geometric shapes.

It should also be apparent that if the operator is unable for any reason to make a complete 360 degree revolution of the spinning handle 40 about the component to be turned, then when the operator reaches the limits of angular travel of the first end 20 of the lever 20, he may merely reverse the head 50 to operatively disengage from the component to be rotated. Typically only a small counter-rotation of the lever 20 is required to enlarge the gripping aperture 60 so that the multipurpose wrench 10 can be freely rotated in the opposite direction. Rotation of the lever 20 in the original direction will then tighten the gripping aperture and gripping head around the component to be turned so that the procedure may commence again.

The operator may also use the wrench 10 for transporting bottles of compressed air by placing one bottle ring through the notch 32 and by placing the ring of a second bottle over the first end 21 of the lever 20 adjacent to and inside of the spinning handle 40. The operator may support and carry the two bottles with one hand placed along an intermediate section of the lever 20.

While the first preferred embodiment of the present invention has been described with specific reference to fire fighting applications, it should be apparent to one skilled in the art that the preferred embodiment may be utilized in a variety of other similar applications with equal efficiency. The first preferred embodiment has been described as an example of the invention as claimed. However, the present invention should not be limited in this application to the details and constructions illustrated in the accompanying drawings of the specification, since the invention may be constructed in a variety of other different embodiments. Also, it must be understood that the terminology and descriptions employed herein are used solely for the purpose of describing the general construction of the device and therefore should not be construed as limitations on the invention or its operability.

I claim:

1. A ratcheting wrench for turning components, such as fire hydrant valve stems, water meter valve stems, fire hose couplers, and the like, comprising in combination:

a lever having first and second ends, with said lever having a convexly curved arcuate portion defining first and second cam surfaces located generally along a longitudinal axis of said lever but spaced from said second end thereof; a pivot disposed along a center line of said arcuate portion and coupled to said lever adjacent said first and second cam surfaces;

a gripping head defining an aperture therein for receiving the component to be turned therethrough, with said gripping head being movably coupled about said pivot so as to move responsive to the magnitude and direction of the torque exerted on said first end of said lever between a tightening direction and position, wherein said gripping head closes upon said first cam surface, and an untightening direction and position, wherein said gripping head closes upon said second cam surface, so as to reduce in both of said positions the effective size of said aperture for gripping the component therein; and said second end of said lever including in a distended section thereof, notch means sized for coupling with and rotating the stem of a water meter valve, said notch means comprising in combination first and second opposing sides each defined by first and second surfaces with said first surfaces of said first and second opposing sides being generally parallel with each other but offset perpendicularly from each other generally by the thickness of the stem of the water meter valve to be rotated.

2. The wrench as defined in claim 1 wherein the effective lever arm is shorter when said gripping means is in said tightening position than when said gripping means is in said untightening position.

3. The wrench as defined in claim 1 further including a handle coupled to said lever adjacent said first end thereof so as to be generally perpendicular to said lever and generally parallel with an axis of rotation of the component being turned, whereby the operator may turn said handle for making continuous full rotations of said lever without regrasping said lever.

4. The wrench as defined in claim 1 wherein said lever further defines a spanner wrench adjacent said second end including a concave curved surface having a notch recessed therein for engaging and turning fire hose couplers.

5. The wrench as defined in claim 1 wherein said first end of said lever is beveled adjacent a distended end thereof in order to form a tip of reduced thickness, whereby said tip may be used as a screwdriver, chisel and crowbar.

6. The wrench as defined in claim 1 wherein said second surfaces of said first and second opposing sides are generally parallel with each other but offset perpendicularly from each other generally by the thickness of the stem of the water meter valve to be rotated.

7. A multipurpose racheting wrench for turning components such as fire hydrant valve stems, fire hose couplers and the like, comprising in combination:

a lever having a first end and a second end;

a handle disposed adjacent said first end of said lever and at right angles thereto;

a notch in said second end of said lever, said notch adapted to couple to a water meter valve stem, said notch sized for coupling with and rotating the stem of a water meter valve, said notch comprising in combination first and second opposing sides each defined by first and second surfaces with said first surfaces of said first and second opposing sides being generally parallel with each other but offset perpendicularly from each other generally by the thickness of the stem of the water meter valve to be rotated;

a cam and spanner portion of said lever adjacent to but spaced apart from said second end of said lever, said cam and spanner portion having a concavely curved surface adjacent a notch recessed therein and adapted to engage fire hose couplers, and an opposing convex arcuate surface defining a first cam surface and a second cam surface;

a gripping head having an aperture therein for receiving a component to be turned therethrough, said gripping head pivoted to said lever at a point along the centerline of said convex arcuate surface, said gripping head adapted to pivot responsive to torque being exerted upon said first end of said lever in a first direction to a tightening position wherein said gripping head closes upon said first cam surface and to ratchet responsive to movement of said lever in a second direction, said gripping head adapted to pivot responsive to torque being exerted upon said first end of said lever in said second direction to an untightening position wherein said gripping head closes upon said second cam surface and to ratchet responsive to movement of said lever in said first direction whereby a component can be tightened and untightened without removal of said gripping head from the component; said first end of said lever including a distended end thereof beveled to form a reduced thickness tip for use as a screwdriver, chisel and crowbar, and a portion of said lever immediately adjacent said second end thereof formed to be used as a hammer.

8. The wrench as defined in claim 7 which further comprises a handling ring attached to said lever for engaging a lanyard or the like.

* * * * *